US006846229B1

(12) United States Patent
Ranieri

(10) Patent No.: US 6,846,229 B1
(45) Date of Patent: Jan. 25, 2005

(54) HANDHELD RETRACTABLE PULL-THROUGH KNIFE SHARPENER

(75) Inventor: Laura A. Ranieri, Palatine, IL (US)

(73) Assignee: World Kitchen (GHC), LLC, Reston, VA (US)

( * ) Notice: Subject to any disclaimer, the term of this patent is extended or adjusted under 35 U.S.C. 154(b) by 0 days.

(21) Appl. No.: 10/707,767

(22) Filed: Jan. 9, 2004

Related U.S. Application Data

(60) Provisional application No. 60/438,919, filed on Jan. 9, 2003.

(51) Int. Cl.[7] ..... B24B 21/00

(52) U.S. Cl. ..... 451/312; 45/45; 45/321; 45/349; 45/549; 45/557

(58) Field of Search ..... 76/82, 88; 451/45, 451/312, 321, 344, 349, 549, 557

(56) References Cited

U.S. PATENT DOCUMENTS

| | | | | |
|---|---|---|---|---|
| ,651,462 | A | | 6/1900 | Jones |
| ,932,724 | A | | 8/1909 | Smith |
| 2,284,168 | A | | 5/1942 | Rickenbacher |
| 3,719,461 | A | | 3/1973 | Topping |
| 4,428,515 | A | | 1/1984 | Mayer |
| 4,558,540 | A | | 12/1985 | Collins |
| 4,628,717 | A | | 12/1986 | Blum |
| 5,040,435 | A | | 8/1991 | Millman |
| 5,377,563 | A | | 1/1995 | Weeks |
| 5,511,311 | A | | 4/1996 | Collins |
| D372,180 | S | * | 7/1996 | Powell ..... D8/91 |
| 5,979,057 | A | | 11/1999 | Chao |
| D421,706 | S | | 3/2000 | Lion et al. |
| 6,039,642 | A | * | 3/2000 | Collins ..... 451/557 |
| 6,101,898 | A | | 8/2000 | Gore et al. |
| 6,219,923 | B1 | | 4/2001 | Sinisi et al. |
| 6,224,475 | B1 | | 5/2001 | May et al. |
| D446,885 | S | | 8/2001 | Newman |
| 2002/0029482 | A1 | | 3/2002 | Peyrot et al. |

* cited by examiner

*Primary Examiner*—Timothy V. Eley
(74) *Attorney, Agent, or Firm*—Seyfarth Shaw LLP

(57) ABSTRACT

A retractable knife sharpener having an ergonomically shaped handle with an internal hollowed portion and an opening at one end thereof in communication with the hollowed portion and a sled slideably received within the hollowed portion and having an outer end with a knife sharpening structure and an inner end and selectively positionable, relative to the handle, between a retracted position and an extended position that exposes the knife sharpening structure.

19 Claims, 2 Drawing Sheets

HANDHELD RETRACTABLE PULL-THROUGH KNIFE SHARPENER

CROSS REFERENCE TO RELATED APPLICATIONS

The present application claims the benefit of the filing date of U.S. Provisional Application No. 60/438,919, filed Jan. 9, 2003, now abandoned.

BACKGROUND OF INVENTION

The present application relates generally to hand-held kitchen knife sharpeners and, more particularly, to a hand-held., retractable, pull-through type knife sharpener.

Kitchen knives require periodic maintenance to ensure that the knife edge remains sharp to promote more productive cutting. It is known that a knife edge can be sharpened by repetitively pulling the knife blade through a knife sharpener consisting of a slot with at least two sharpening members made of a hardened material, such as ceramic, and angled relative to each other to form a V-shaped groove through which the knife edge is designed to pass. By maintaining an appropriate angle between the sharpening members, simultaneous sharpening of both sides of the knife edge is facilitated with minimal effort when the knife is pulled therebetween. However, there exists a need to maintain and protect the sharpening members during nonuse and storage.

SUMMARY OF INVENTION

The present application discloses a new and improved knife sharpening apparatus with a retractable, V-shaped, pull-through knife sharpener housed within a handle. The handle comprises a housing and a slideable sled. The sled is slideably received inside the housing. The sled further, incorporates a pull-through type knife sharpener. As such, when the sharpener's use is not required, the sled can be retracted inside of the handle, thus protecting the surfaces of the sharpening members. When use of the poll through sharpener is desired, the user simply extends the sled from the handle to expose the sharpener. The sled can then be retained in place with a retaining mechanism during the sharpening process.

BRIEF DESCRIPTION OF DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages, should be readily understood and appreciated.

DETAILED DESCRIPTION

Disclosed herein is an improved retractable pull-through type knife sharpener apparatus. Referring to the figures, a sharpener 10 includes a handle 20 with a housing 21 having an internal hollowed portion 21*a* and an opening 21*b* at one end and an outer surface of an ergonomically efficient design to optimize hand-held use of the sharpener 10. The handle 20 may also include an over-molded portion 22 made of a grip-enhancing material.

Figure 1:
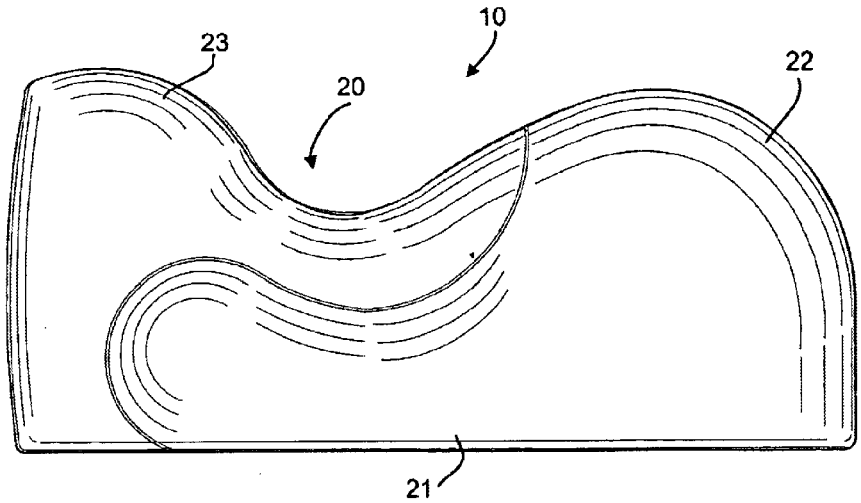
FIG. 1 is a side elevational view of a retractable pull-through knife sharpener of the present application with the sharpener depicted in a retracted position.
Figure 2:
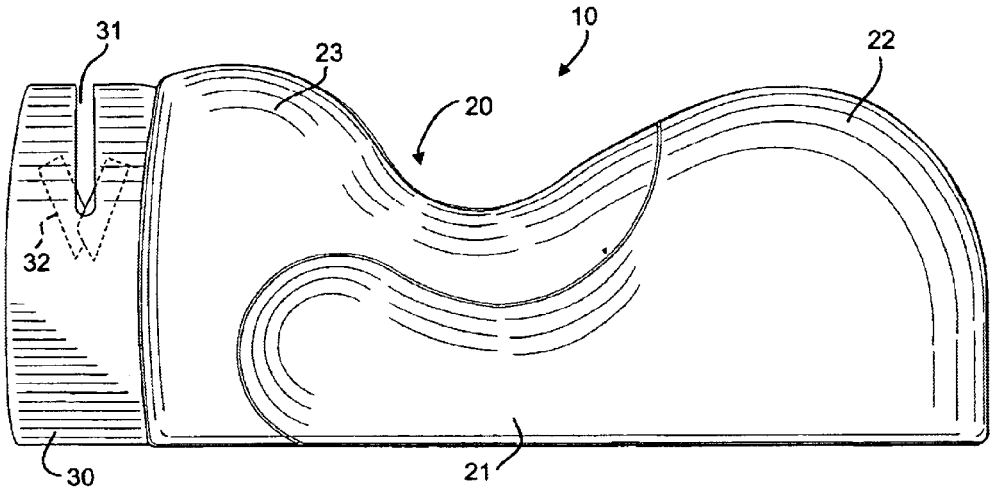
FIG. 2 is a side elevational view of the retractable pull-through knife sharpener of FIG. 1 with the sharpener depicted in an extended position.

A sled 30 is provided with a size and shape to be slideably received within the hollowed portion of the housing 21 through the opening. The sled 30 includes a pull-through type sharpening structure consisting of an elongated slot 31 terminating with a plurality of sharpening members 32 situated relative to each other to form a substantially V-shaped groove. The sharpening members 32 may be ceramic rods. It is anticipated that the sharpening structure be used in a manner well known to receive the cutting edge of a knife blade, whereupon the knife blade is pulled through the slot 31 to contact the sharpening members 32. When the knife blade is pulled through the slot 31 in this manner, simultaneous sharpening of both sides of the knife blade edge occurs. This ensures even and effective sharpening of the knife blade and maintenance of the proper angle of the blade edge. As depicted in FIG. 2, the sled 30 is in an extended position exposing the sharpening structure for use.

Figure 3:
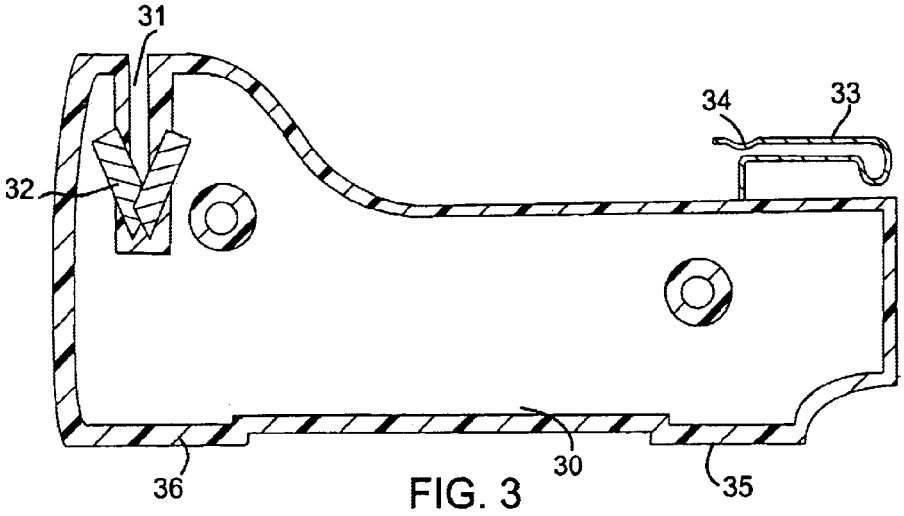
FIG. 3 is a side elevational view of the sled of the present application removed from the handle for clarity.

The sled 30 may also comprise a retaining mechanism 33 (FIGS. 3 and 4) on its inner end for retainable engagement with the housing 21 when the sled 30 is slideably extended from the housing 21 hollowed portion. Placement of the retaining mechanism 33 defines the longitudinal limits of the sliding travel of the sled 30 relative to the housing 21. The sled 30 may therefore be retained in either an extended position, exposing the sharpening structure relative to the housing 21, or a retracted position, wherein the sharpening structure is enclosed within the housing 21 to facilitate storage. The retaining mechanism 33 may be a resilient member extending from the sled 30 and with a detent structure 34, such as a recess, disposed thereon.

The sled 30 may further comprise sled guides 35, 36 for guiding the sled 30 in the housing 21. Sled guide 35 may be accessible to the user through an aperture 35*a* in the housing 21 to facilitate disengagement of the retaining mechanism 33 when the user applies minimal longitudinal force and subsequently slides the sled 30 to a desired position relative to the housing 21.

Figure 4:
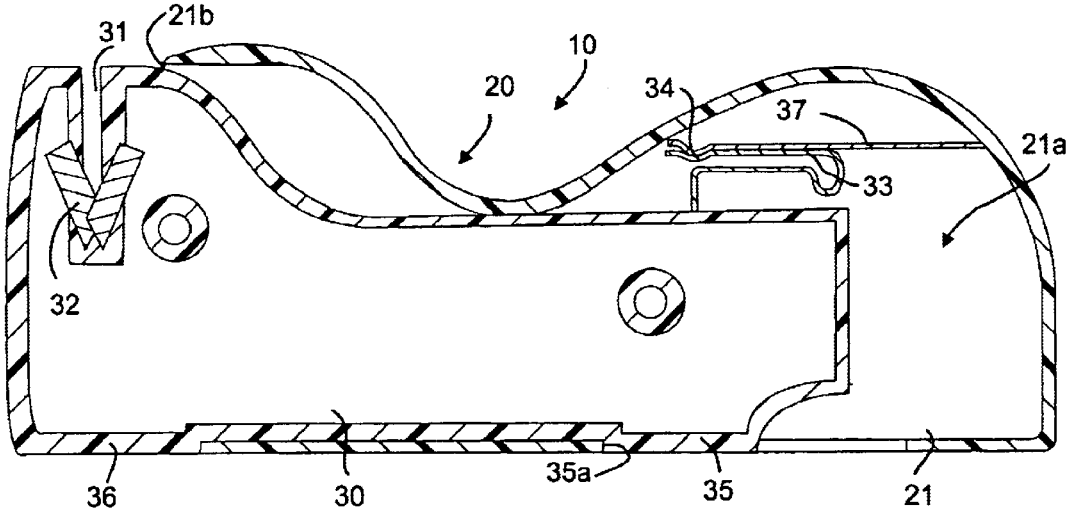
FIG. 4 is a longitudinal cross-sectional view of the retractable pull-through knife sharpener of FIG. 2.

Referring to FIG. 4, the sled 30 is depicted in an extended position exposing the sharpening structure for use. The recess 34 may engageably receive complementary detent projections 38 (one shown in FIG. 5) for resiliently retaining the sled 30 in its retracted and extended positions.

Figure 5:
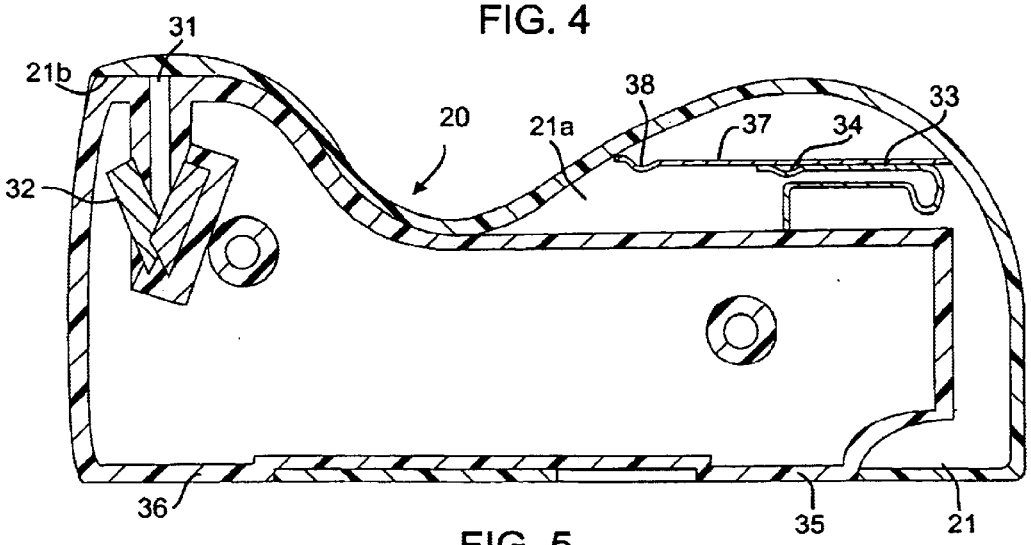
FIG. 5 is a longitudinal cross-sectional view of the retractable pull-through knife sharpener of FIG. 1.

Referring to FIG. 5, the sled 30 is depicted in a retracted position wherein the sharpening structure is housed within the housing 21. In this position, the sharpening structure can be stored and protected.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following, claims when viewed in their proper perspective based on the prior art.

What is claimed is:

1. A retractable knife sharpener comprising:

an ergonomically shaped handle having an internal hollowed portion and an opening at one end thereof in communication with the hollowed portion thereby defining a housing;

a sled slidably received within the hollowed portion and having an outer end and an inner end and a sled guide;

an aperture disposed on the housing in communication with the hollowed portion to provide accessibility to the sled guide from outside of the housing; and a sharpening structure carried by the sled at its outer end;

wherein the sled is selectively positionable, relative to the handle, between a retracted position enclosing the sharpening structure and an extended position exposing the sharpening structure, by applying a substantially longitudinal force to the sled guide.

2. The sharpener as claimed in claim 1 wherein the sharpening structure includes a pull-through type sharpener.

3. The sharpener as claimed in claim 2 wherein the sharpening structure includes an elongated slot and a plurality of sharpening members that are situated relative to each other to form a substantially V-shaped groove.

4. The sharpener as claimed in claim 3 wherein the sharpening members include ceramic rods.

5. The sharpener as claimed in claim 1 wherein the sled includes a retaining mechanism disposed on the inner end for retainable engagement with the housing.

6. The sharpener as claimed in claim 5 wherein the retaining mechanism retainably engages the housing in the extended position.

7. The sharpener as claimed in claim 5 wherein the retaining mechanism retainably engages the housing in the retracted position.

8. The sharpener as claimed in claim 5 wherein the retaining mechanism includes a resilient member extending from the sled and having a first detent structure disposed thereon.

9. The sharpener as claimed in claim 8 wherein the housing includes a complementary second detent structure for retainable engagement with the first detent structure.

10. The sharpener as claimed in claim 1 wherein the handle includes a grip enhancing material.

11. A knife sharpener comprising:

a handle having an internal hollowed portion and an opening at one end thereof in communication with the hollowed portion thereby defining a housing;

a sled slidably received within the hollowed portion and having inner and outer ends and a sled guide and selectively positionable between retracted and extracted positions relative to the handle;

an aperture disposed on the housing to provide accessability to the sled guide from outside of the housing; and a pull-through type sharpening structure disposed on the outer end having an elongated slot terminating with a plurality of member situated relative to each other to form a substantially V-shaped groove.

12. The sharpener as claimed in claim 11 wherein the handle is ergonomically shaped.

13. The sharpener as claimed in claim 11 wherein the sharpening members are ceramic rods.

14. The sharpener as claimed in claim 11 wherein the sled includes a retaining mechanism disposed on the inner and for retainable engagement with the housing.

15. The sharpener as claimed in claim 14 wherein the retaining mechanism retainably engages the housing in the extended position.

16. The sharpener as claimed in claim 14 wherein the retaining mechanism retainably engages the housing in the retracted position.

17. The sharpener as claimed in claim 14 wherein the retaining mechanism includes a resilient member extending from the sled and having a first detent structure disposed thereon.

18. The sharpener as claimed in claim 17 wherein the housing includes a complementary second detent structure for retainable engagement with the first detent structure.

19. The sharpener as claimed in claim 11 wherein the handle includes a grip enhancing material.

* * * * *